US011247498B2

(12) United States Patent
Iwamoto

(10) Patent No.: US 11,247,498 B2
(45) Date of Patent: Feb. 15, 2022

(54) PRINTER DEVICE AND CUTTER DEVICE

(71) Applicant: TOSHIBA TEC KABUSHIKI KAISHA, Tokyo (JP)

(72) Inventor: Jun Iwamoto, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/078,294

(22) Filed: Oct. 23, 2020

(65) Prior Publication Data

US 2021/0252888 A1 Aug. 19, 2021

(30) Foreign Application Priority Data

Feb. 18, 2020 (JP) ..... JP2020-025315

(51) Int. Cl.

| | |
|---|---|
| ***B41J 11/70*** | (2006.01) |
| ***B41J 29/17*** | (2006.01) |
| ***B41J 11/04*** | (2006.01) |
| ***B41J 2/32*** | (2006.01) |
| *B41J 3/407* | (2006.01) |

(52) U.S. Cl.

CPC ..... *B41J 29/17* (2013.01); *B41J 2/32* (2013.01); *B41J 11/04* (2013.01); *B41J 11/703* (2013.01); *B41J 3/4075* (2013.01)

(58) Field of Classification Search

CPC ..... B41J 11/66; B41J 29/17; B41J 11/703; B41J 11/04; B41J 2/32; B41J 3/4075

See application file for complete search history.

(56) References Cited

U.S. PATENT DOCUMENTS

| | | | | |
|---|---|---|---|---|
| 8,459,886 | B2 * | 6/2013 | Furuki | B41J 13/0009 400/621 |
| 10,239,335 | B2 | 3/2019 | Kato | |
| 2014/0253660 | A1 * | 9/2014 | Amano | B41J 15/005 347/218 |

* cited by examiner

*Primary Examiner* — Huan H Tran

(74) *Attorney, Agent, or Firm* — Amin, Turocy & Watson, LLP

(57) ABSTRACT

According to one embodiment, there is provided a printer device which prints on an adhesive member including an adhesive material on one surface and includes a thermal head, a platen, a fixed blade, a movable blade, an operation unit, and a control unit. The thermal head prints on the adhesive member by generating heat. The platen is arranged to face the thermal head. The fixed blade is arranged at a position where a blade edge faces a conveyance path of the adhesive member conveyed between the thermal head and the platen. The movable blade is arranged at a position where a blade edge of the movable blade faces the blade edge of the fixed blade via the conveyance path and moved at a first speed to a position where the blade edge of the movable blade is brought into contact with the blade edge of the fixed blade. The operation unit receives a first operation for instructing to start cleaning the movable blade from an operator. The control unit moves the movable blade to a position where the blade edge of the movable blade is exposed above the conveyance path at a second speed slower than the first speed when the operation unit receives the first operation.

20 Claims, 4 Drawing Sheets

PRINTER DEVICE AND CUTTER DEVICE

CROSS-REFERENCE TO RELATED APPLICATION

This application is based upon and claims the benefit of priority from Japanese Patent Application No. 2020-025315, filed on Feb. 18, 2020, the entire contents of which are incorporated herein by reference.

FIELD

Embodiments described herein relate generally to a printer device and a cutter device.

BACKGROUND

In recent years, there has been known a printer device which prints information on a linerless label (a label without a mount). Before printing, the linerless label is wound into a roll and stored in a label printer. The printer device cuts the linerless label after printing with a cutter device into a predetermined length to generate a label which can be attached to an object such as a merchandise item.

When cutting linerless labels, an adhesive material may stick to a blade of the cutter device and remain. Therefore, in such a label printer, it is recommended that the blade be manually cleaned periodically using, for example, a cotton swab or a dedicated brush.

However, except when the linerless label is cut, the blade of the cutter device is accommodated so as not to be exposed in order to reduce accidental contact of an operator with the cutter blade. Therefore, the blade cleaning operation may be time-consuming.

DETAILED DESCRIPTION

The problem to be solved by the invention is to facilitate cleaning of a cutter blade for cutting a linerless label.

In general, according to one embodiment, there is provided a printer device which prints on an adhesive member including an adhesive material on one surface and includes a thermal head, a platen, a fixed blade, a movable blade, an operation unit, and a control unit. The thermal head prints on the adhesive member by generating heat. The platen is arranged to face the thermal head. The fixed blade is arranged at a position where a blade edge faces a conveyance path of the adhesive member conveyed between the thermal head and the platen. The movable blade is arranged at a position where a blade edge of the movable blade faces the blade edge of the fixed blade via the conveyance path and moved at a first speed to a position where the blade edge of the movable blade is brought into contact with the blade edge of the fixed blade. The operation unit receives a first operation for instructing to start cleaning the movable blade from an operator. The control unit moves the movable blade to a position where the blade edge of the movable blade is exposed above the conveyance path at a second speed slower than the first speed when the operation unit receives the first operation.

EMBODIMENT

Figure 1:
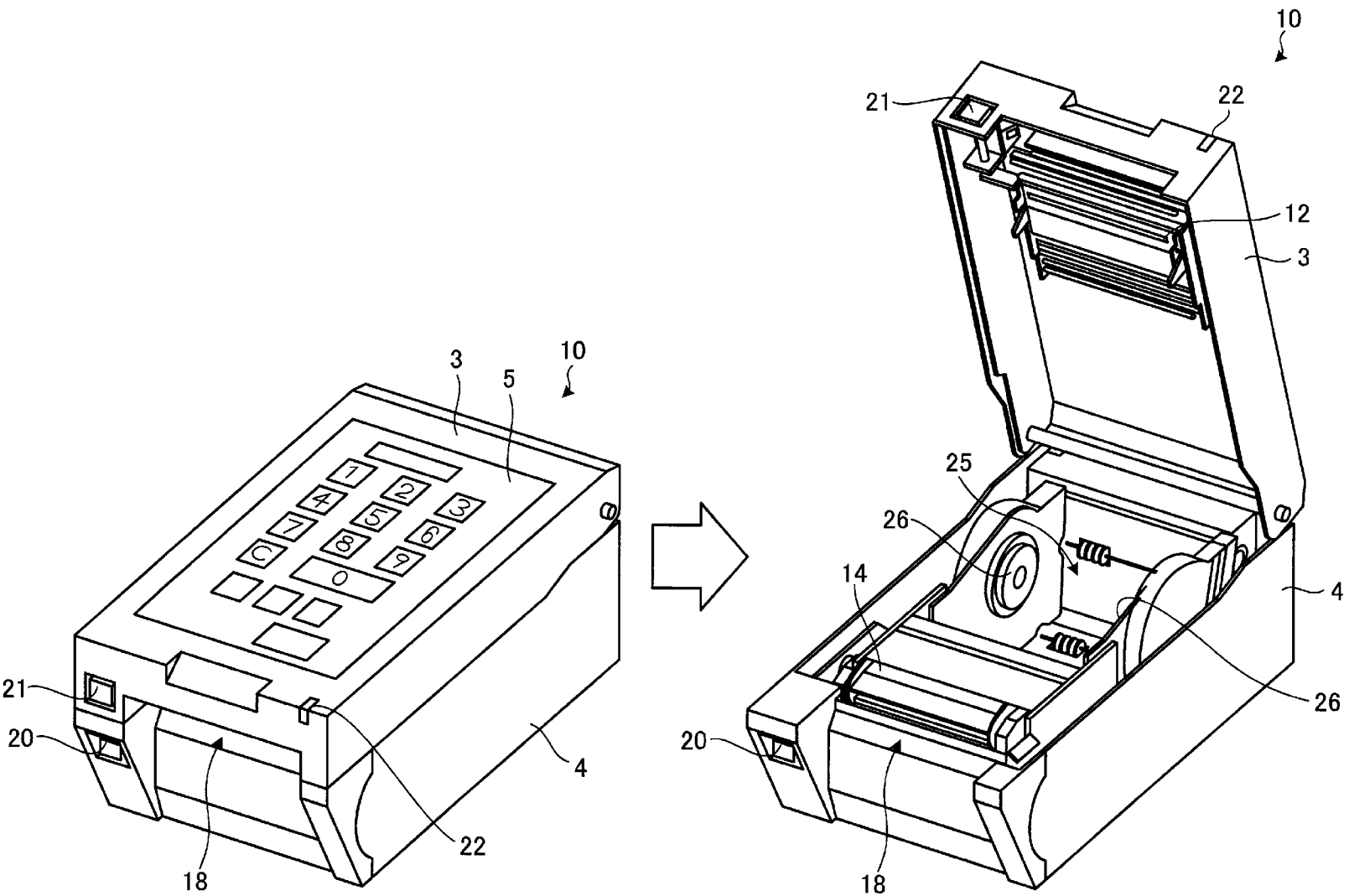
FIG. 1 is a diagram illustrating an example of an external appearance of a label printer according to an embodiment.

FIG. 1 is a perspective view illustrating an example of an external appearance of a label printer 10 according to an embodiment. The label printer 10 is an example of a printer device and a cutter device according to the embodiment. The label printer 10 is a printer which prints a label to be attached to an object such as a merchandise item in a store such as a supermarket. The left side of FIG. 1 illustrates an example of an external appearance when an upper case 3 of the label printer 10 is in a closed state. The right side of FIG. 1 illustrates an example of the external appearance when the upper case 3 of the label printer 10 is in an open state.

As illustrated on the left side of FIG. 1, the label printer 10 includes the upper case 3, a lower case 4, a paper discharge port 18, a power switch 20, a feed button 21, an indicator 22, and a touch panel display 5. Further, as illustrated on the right side of FIG. 1, the label printer 10 further includes a thermal head 12, a platen roller 14, a paper storage unit 25, and a holding unit 26.

The paper storage unit 25 rotatably stores a roll around which the linerless label before printing is wound.

The linerless label is a label paper without a mount (liner) and has an adhesive material on an adhesive surface which is the back surface of the printing surface, for example. Further, in the embodiment, the linerless label is a thermal paper. The linerless label is an example of a sticking member.

The linerless label is, for example, wound with the sticking surface inside, but may be wound with the sticking surface outside. The linerless label is pulled out by a predetermined length at the time of printing, and after printing, cut into a predetermined length by a cutter described below.

The platen roller 14 is rotated by transmission of a driving force of a stepping motor, which will be described below, and conveys the label paper interposed between the platen roller 14 and the thermal head 12 from the paper storage unit 25 toward the paper discharge port 18. The platen roller 14 and the thermal head 12 face each other via a paper conveyance path along which the label paper is conveyed. The paper storage unit 25 is located on an upstream side in a conveyance direction of the label paper and the paper discharge port 18 is located on the upstream side in the conveyance direction. A path through which the label paper is conveyed from the paper storage unit 25 to the paper discharge port 18 is called a paper conveyance path.

Further, a cutter (not illustrated) is provided on the upstream side of the paper discharge port 18 in the conveyance direction and on a downstream side of the platen roller 14 in the conveyance direction. The cutter cuts the label paper after printing into predetermined lengths under the control of a controller described below. The cut length of the label paper is variable depending on the information to be printed, for example. The cutter is not illustrated in FIG. 1 because it is hidden in an accommodation position below the paper conveyance path except when the label paper is being cut or when the cutter blade is in a cleaning mode which will be described below.

Hereinafter, in the embodiment, the linerless label before being cut by the cutter is referred to as label paper. A linerless label cut into a predetermined length by the cutter is called a label.

The thermal head 12 prints on the linerless label by generating heat. For example, the thermal head 12 includes a plurality of heating elements provided in parallel and the heat generated by the heating elements prints on the label paper interposed between the thermal head 12 and the platen roller 14. Specifically, the thermal head 12 prints information about the merchandise item on the printing surface of the label paper under the control of the controller described below. The information about the merchandise item is, for example, a barcode or discount information, but is not limited to these.

The lower case 4 is a case whose upper surface is open and the upper surface is closed by the upper case 3. Further, the lower case 4 is provided with a connection terminal (not illustrated) used for connecting the label printer 10 to an external device, a power supply terminal (not illustrated) for supplying power to the label printer 10, and the like.

The rear side of the upper case 3 is pivotally attached to the lower case 4. The upper case 3 includes the thermal head 12 on the front surface side (the side far from the pivot axis). With the pivot of the upper case 3, the upper surface of the lower case 4 is opened or closed. The upper case 3 is also called a cover and is an example of a lid portion in the embodiment. The upper case 3 and the lower case 4 are examples of the housing of the label printer 10. When the upper case 3 covers the lower case 4, the thermal head 12 faces the platen roller 14. The paper conveyance path is formed between the upper case 3 which covers the lower case 4 and the lower case 4.

Between the lower front end of the upper case 3 and the upper front end of the lower case 4, the paper discharge port 18 for discharging the label paper on which information is printed is provided.

The touch panel display 5 is, for example, a liquid crystal display in which touch panels are stacked. The touch panel display 5 is provided on an upper surface of the upper case 3 as an example.

The power switch 20 is a switch which turns on or off the power to the label printer 10 when pressed by an operator.

The indicator 22 is composed of, for example, an LED, and displays the state of the label printer 10 including the power-on state and the like by lighting or blinking.

When the feed button 21 is pressed by an operator, the feed button 21 transmits a signal indicating that the button has been pressed to the controller described below. The feed button 21 is an example of an operation unit in the embodiment. Also, the power switch 20 and the feed button 21 are assumed to be physical buttons.

For example, the feed button 21 functions as a button for conveying a predetermined amount of label paper from the paper storage unit toward the paper discharge port 18 when pressed by an operator.

Further, in the embodiment, the feed button 21 is also a button capable of accepting a first operation for instructing the start of cleaning of a movable blade described below from an operator. Further, the feed button 21 can receive a second operation for instructing the end of cleaning of the movable blade from an operator. In the embodiment, the controller, which will be described below, accepts different operations by an operator depending on the length of time that the feed button 21 is pressed or an open-or-closed state of the upper case 3 when the feed button 21 is pressed. Details of the first operation and the second operation will be described below.

Next, the configuration of the label printer 10 in the embodiment will be described in more detail.

Figure 2:
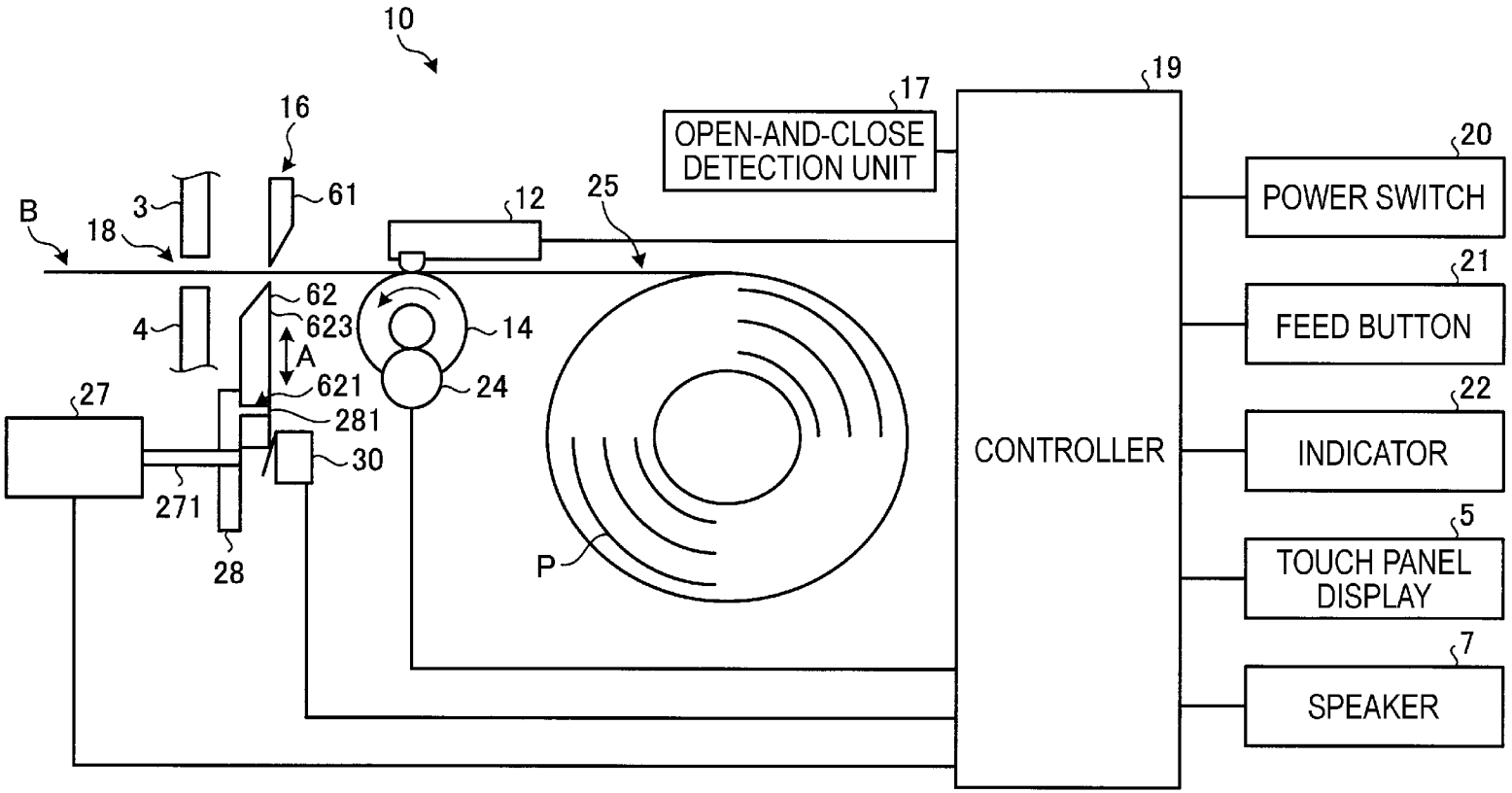
FIG. 2 is a block diagram illustrating an example of an internal configuration of the label printer according to the embodiment.

FIG. 2 is a block diagram illustrating an example of the internal configuration of the label printer 10 according to the embodiment. As illustrated in FIG. 2, the label printer 10 includes an open-and-close detection unit 17, a speaker 7, a controller 19, a stepping motor 24, a position sensor 30, a stepping motor 27, and a cam 28 in addition to the configuration illustrated in FIG. 1.

As illustrated in FIG. 2, a label paper P rolled into a roll is conveyed while being interposed between the thermal head 12 and the platen roller 14. In this case, the platen roller 14 is rotated by the stepping motor 24 from the paper storage unit 25 side toward the paper discharge port 18 side while being pressed against the thermal head 12. The platen roller 14 conveys the label paper P from the paper storage unit 25 side toward the paper discharge port 18 side by such rotation. The stepping motor 24 is driven under the control of the controller 19 to rotate the platen roller 14.

In the embodiment, printing is performed on the label paper P while being interposed between the thermal head 12 and the platen roller 14, and the conveying force is applied from the rotating platen roller 14.

The label paper P reaches a cutter 16 after passing between the thermal head 12 and the platen roller 14. The cutter 16 includes a fixed blade 61 and a movable blade 62.

The fixed blade 61 is fixed to the upper case 3 side so that when the upper case 3 covers the lower case 4, the blade edge faces the paper conveying path. The blade edge of the fixed blade 61 is located closer to the thermal head 12 side than the conveyance path of the label paper P interposed between the thermal head 12 and the platen roller 14. In other words, the fixed blade 61 is located above the paper conveyance path. The shape of the fixed blade 61 is, for example, a shape in which the blade edge is horizontal with respect to the label paper P, but is not limited to this.

When the upper case 3 covers the lower case 4, the movable blade 62 is disposed at a position where the blade edge faces the blade edge of the fixed blade 61 via the paper conveyance path. The movable blade 62 cuts the label paper P by moving from the accommodation position toward the blade edge of the fixed blade 61. The position on the conveyance path of the movable blade 62 when the fixed blade 61 and the movable blade 62 contact each other above the conveyance path and the label sheet P is cut is referred to as a cutting position for convenience of description. The cutting position is an example of the second position in the embodiment.

In the example illustrated in FIG. 2, the movable blade is in the accommodation position. The accommodation position is closer to the platen roller 14 side than the label paper P interposed between the thermal head 12 and the platen roller 14. In the accommodation position, the blade edge of the movable blade 62 is located below the paper conveyance path. When the movable blade 62 is in the accommodation position, the movable blade 62 is separated from the fixed blade 61. When the upper case 3 covers the lower case 4, the blade edge of the movable blade 62 faces the blade edge of the fixed blade 61 via the paper conveyance path. The accommodation position is also called a home position and is an example of the first position in the embodiment.

When the upper case 3 covers the lower case 4, the movable blade 62 at the cutting position is located closer to the thermal head 12 side than the conveyance path of the label paper P interposed between the thermal head 12 and the platen roller 14. At the cutting position, the blade edge of the movable blade 62 projects above the paper conveyance path. When the upper case 3 covers the lower case 4, the movable blade 62 contacts the fixed blade 61 when the movable blade 62 is in the cutting position. When the movable blade 62 and the fixed blade 61 contact each other, the label paper P is cut.

When the label paper P is cut, the adhesive material applied to the label paper P adheres to a contact surface 623 of the movable blade 62 which is in contact with the fixed blade 61. The adhesive is applied only to the back surface of the label paper P and not to the printing surface. Therefore, the adhesive material easily adheres to the movable blade 62, but the adhesive material does not easily adhere to the fixed blade 61.

After cutting the label paper P, the movable blade 62 moves below the paper conveyance path and returns to the accommodation position. That is, the movable blade 62 reciprocates in a direction of the arrow A.

The movable blade 62 moves along with the rotational movement of the stepping motor 27. The disk-shaped cam 28 is attached to the tip of a rotation shaft 271 of the stepping motor 27 and a pin 281 provided on the cam 28 is inserted into a groove 621 formed in the movable blade 62. Then, as the stepping motor 27 rotates, the pin 281 reciprocates the movable blade 62 in the direction of the arrow A. The vertical position of the movable blade 62 is measured by the position sensor 30. Since the stepping motor 27 stops rotating based on the output of the position sensor 30, the movable blade 62 stops at a predetermined position after cutting the label paper P.

The movable blade 62 moves upward or downward by a predetermined distance for each step of the stepping motor 27. Therefore, the shorter the step execution interval of the stepping motor 27, the faster the movement, and the longer the step execution interval of the stepping motor 27, the slower the movement. In the embodiment, the movable blade 62 moves at a first speed when cutting the label paper P, and moves at a second speed slower than the first speed in the cleaning mode of the movable blade 62 of the cutter 16.

The shape of the movable blade 62 is, for example, a shape in which the blade edge inclines from one end to the other end with respect to a horizontal direction, but is not limited to this. For example, the movable blade 62 may have a valley shape in which the blade edge is symmetrically inclined from both ends toward the center.

The label paper P cut by the fixed blade 61 and the movable blade 62 becomes a label having a predetermined length. The cut label is discharged from the paper discharge port 18 formed in a gap between the upper case 3 and the lower case 4.

Under the control of the controller 19, the stepping motor 27 rotates to move the cam 28, thereby moving the movable blade 62 in the vertical direction. The stepping motor 27 and the cam 28 cut the label paper P by moving the movable blade 62 from the accommodation position to the cutting position at the first speed and bringing the movable blade 62 into contact with the fixed blade 61. The stepping motor 27 and the cam 28 are examples of the cutting mechanism and the driving mechanism in the embodiment.

The open-and-close detection unit 17 is a sensor which detects whether the upper case 3 is in an open state or a closed state. The open-and-close detection unit 17 is a sensor provided with an electrical contact that becomes energized when the upper case 3 is closed and comes into contact with the lower case 4, and conversely, non-energized when the upper case 3 opens and separates from the lower case 4.

The position sensor 30 is a sensor which detects the position of the movable blade 62. For example, the position sensor 30 outputs a signal indicating an ON state when the movable blade 62 is at the accommodation position, which is the lowest position, and outputs a signal indicating an OFF state when the movable blade 62 is not at the accommodation position, which is the lowest position.

The speaker 7 emits sound or voice under the control of the controller 19. For example, the speaker 7 emits a warning sound such as a beep sound. The speaker 7 is an example of an output unit.

The controller 19 is a computer including a control device such as a Central Processing Unit (CPU) and a storage device such as a Read Only Memory (ROM) or a Random Access Memory (RAM). The controller 19 may further include a writable non-volatile storage device such as a flash memory.

The controller 19 controls the operation of the entire label printer 10 by executing a control program stored in the storage device such as a ROM or a flash memory. For example, the controller 19 receives print data from a POS terminal or the like (not illustrated) connected to the label printer 10 and executes a print operation. The controller 19 is an example of a control unit.

The controller 19 controls the operations of the thermal head 12 and the stepping motors 24 and 27. Further, the controller 19 monitors the position of the movable blade 62 of the cutter 16 by receiving the output of the position sensor 30. Further, the controller 19 monitors the open-or-closed state of the upper case 3 by receiving the output of the open-and-close detection unit 17. Further, the controller 19 monitors the operation states of the power switch 20 and the feed button 21. The controller 19 also controls the speaker 7, the indicator 22, and the touch panel display 5.

For example, the controller 19 has a normal operation mode, a feed mode, a setting mode, and a cleaning mode and controls each part of the label printer 10 according to the mode. The processing content of each mode is defined by a control program stored in a storage device such as a ROM or a flash memory.

A normal operation mode is, for example, a mode in which a printing operation on the label paper P by the thermal head 12, a rotation operation of the platen roller 14 by the stepping motor 24, a cutting operation of the label paper P by the stepping motor 27, and the like are executed. In the normal operation mode, the controller 19 cuts the label paper P by controlling the stepping motor 27 so as to move the movable blade 62 from the accommodation position to the cutting position at the first speed. The controller 19 moves the movable blade 62 at the first speed by, for example, continuously driving the stepping motor 27.

Further, a feed mode is a mode in which the platen roller 14 is rotated to feed the label paper P from the paper storage unit 25 side to the paper discharge port 18 side. For example, the controller 19 shifts the mode from the normal operation mode to the feed mode when the upper case 3 is in the closed state and the time when the feed button 21 is pressed is less than a threshold value. In this case, the controller 19 controls the stepping motor 24 so as to rotate the platen roller 14 by a predetermined rotation amount.

A setting mode is a mode in which an operator can change various settings of the label printer 10. For example, the controller 19 shifts the mode from the normal operation mode to the setting mode when the upper case 3 is in the open state and the time when the feed button 21 is pressed is less than the threshold value. In this case, the touch panel display 5 displays a setting input screen.

Further, a cleaning mode is a mode in which the controller 19 moves the movable blade 62 from the accommodation position to the cutting position at the second speed slower than the first speed in order for an operator to clean the movable blade 62. As described with reference to FIG. 3, when the label paper P is cut, the adhesive material applied to the label paper P adheres to the contact surface 623 of the movable blade 62 which is a surface in contact with the fixed blade 61. When the adhesive material is attached to the movable blade 62, the cutting failure of the label paper P may occur. In addition, the adhesive material may cause the fixed blade 61 and the movable blade 62 to adhere to each other, resulting in an increase in the electric power required to move the movable blade 62 at the time of subsequent cutting. Therefore, an operator carries out the work of cleaning the movable blade 62.

For example, the controller 19 shifts the mode from the normal operation mode to the cleaning mode when the upper case 3 is in the open state and the length of time the feed button 21 is pressed is equal to or more than the threshold value. In addition, in the embodiment, the pressing of the feed button 21 for a time equal to or more than the threshold value is regarded as the acceptance of the first operation of the feed button 21.

The controller 19 controls the stepping motor 27 so as to move the movable blade 62 from the accommodation position to the cutting position at the second speed slower than the first speed when shifting to the cleaning mode. That is, in the cleaning mode, the movable blade 62 moves from the accommodation position to the cutting position at a slower speed than when the label paper P is cut in the normal operation mode. The speed of the second speed is not particularly limited, but as an example, it is set to a speed at which an operator can visually confirm that the movable blade 62 is moving upward. The controller 19 moves the movable blade 62 at the second speed slower than the first speed by, for example, intermittently driving the stepping motor 27.

Figure 3:
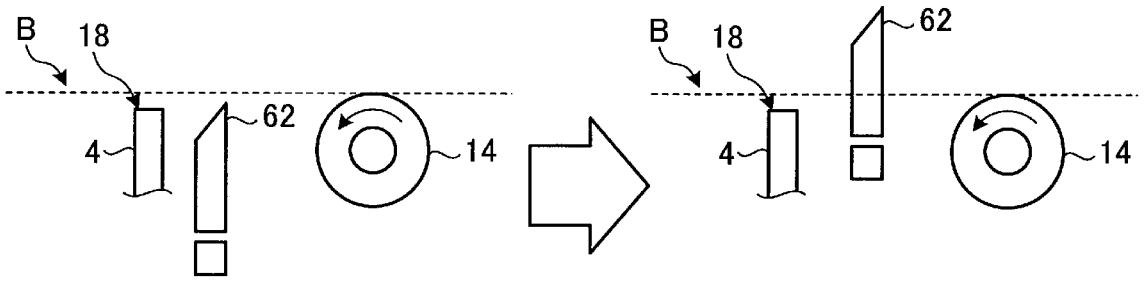
FIG. 3 is a diagram comparing an accommodation position and a cutting position of a movable blade according to the embodiment.

FIG. 3 is a diagram comparing the accommodation position and the cutting position of the movable blade 62 according to the embodiment. The left side of FIG. 3 illustrates the movable blade 62 in the accommodation position. The right side of FIG. 3 illustrates the movable blade 62 in the cutting position.

In the example illustrated in FIG. 3, it is assumed that the upper case 3 is open and the label paper P is not set. In FIG. 3, in order to explain the position of the movable blade 62, the movable blade 62, the lower case 4, and the platen roller 14 are illustrated and other configurations are omitted. Similar to FIG. 2, a conveyance path B illustrated in FIG. 3 represents a path along which the label paper P is conveyed when the label paper P is interposed between the thermal head 12 and the platen roller 14.

As illustrated on the left side of FIG. 3, in the accommodation position, the movable blade 62 is buried between the paper discharge port 18 of the lower case 4 and the platen roller 14. On the other hand, as illustrated on the right side of FIG. 3, at the cutting position, the movable blade 62 projects from a portion between the paper discharge port 18 of the lower case 4 and the platen roller 14 and is exposed.

Referring back to FIG. 2, the controller 19 causes the speaker 7 to output a warning sound when the feed button 21 receives the first operation. More specifically, the controller 19 causes the speaker 7 to output a warning sound when the upper case 3 is in the open state and the length of time the feed button 21 is pressed is equal to or more than the threshold value. That is, the controller 19 causes the speaker 7 to output a warning sound during the cleaning mode until the movable blade 62 starts moving and reaches the cutting position.

Further, when the feed button 21 is pressed by an operator after shifting to the cleaning mode, the feed button 21 accepts the pressing operation as a second operation for instructing the operator to finish cleaning the movable blade 62. When the feed button 21 receives the second operation, the controller 19 controls the stepping motor 27 so as to return the movable blade 62 from the cutting position to the accommodation position.

That is, until an operator presses the feed button 21 again, the movable blade 62 stops in the state of being raised from the accommodation position to the cutting position. As described in FIG. 3, when the movable blade 62 is at the cutting position, the movable blade 62 is in a state of protruding from the portion between the paper discharge port 18 of the lower case 4 and the platen roller 14. The protruding amount of the movable blade 62 is not particularly limited, but is about 5 mm, for example. Therefore, an operator can easily clean the movable blade 62 stopped in the protruding state by using, for example, a cotton swab or a dedicated brush.

When the movable blade 62 is in the cutting position, if the upper case 3 is in the open state and the label paper P does not cover the movable blade 62, an operator can visually recognize the movable blade 62. Further, in this case, an operator can easily visually confirm whether the movable blade 62 has been sufficiently cleaned.

In addition, in the embodiment, the speed at which the movable blade 62 returns from the cutting position to the accommodation position is the same as the first speed at the time of cutting the label paper P, but may be the second speed. When the movable blade 62 returns from the cutting position to the accommodation position, the controller 19 ends the cleaning mode and shifts to the normal operation mode. The types of modes that the controller 19 has are not limited to the above examples.

Next, the flow of processing in the cleaning mode executed by the controller 19 configured as described above will be specifically described.

Figure 4:
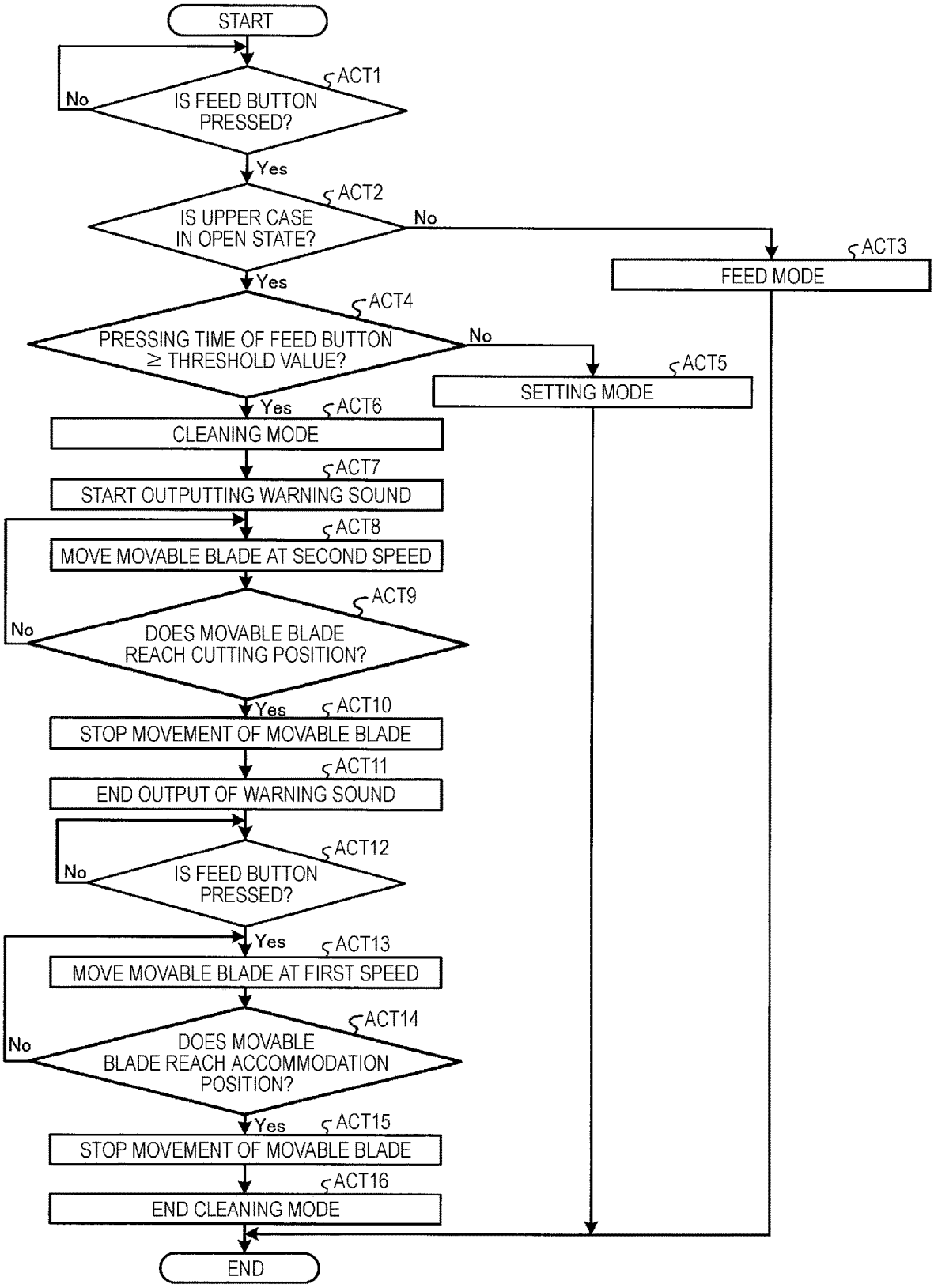
FIG. 4 is a flowchart illustrating an example of a processing flow of a cleaning mode according to the embodiment.

FIG. 4 is a flowchart illustrating an example of the flow of processing in the cleaning mode according to the embodiment. As a premise of the process of this flowchart, the controller 19 is assumed to be in the normal operation mode.

First, the controller 19 determines whether the feed button 21 has been pressed by an operator (ACT 1). When the controller 19 determines that the feed button 21 is not pressed by an operator (ACT 1 "No"), the process of ACT 1 is repeated.

When the controller 19 receives a signal indicating that the feed button 21 has been pressed from the feed button 21, the controller 19 determines that the feed button 21 has been pressed by an operator (ACT 1 "Yes"). In this case, the controller 19 determines whether the upper case 3 is in the open state (ACT 2).

When acquiring the detection result that the upper case 3 is in the closed state from the open-and-close detection unit 17, the controller 19 determines that the upper case 3 is not in the open state (ACT 2 "No"). In this case, the controller 19 transitions to the feed mode (ACT 3). In this case, the controller 19 controls the stepping motor 24 so as to rotate the platen roller 14 by a predetermined rotation amount.

Moreover, when the controller 19 obtains the detection result that the upper case 3 is in the open state from the open-and-close detection unit 17, the controller 19 determines that the upper case 3 is in the open state (ACT 2 "Yes"). In this case, the controller 19 determines whether the pressing time of the feed button 21 is equal to or more than the threshold value (ACT 4). When the controller 19 determines that the pressing time of the feed button 21 is less than the threshold value (ACT 4 "No"), the controller 19 shifts the mode to the setting mode.

When the controller 19 determines that the pressing time of the feed button 21 is equal to or more than the threshold value (ACT 4 "Yes"), the controller 19 shifts the mode to the cleaning mode (ACT 6).

In this case, the controller 19 controls the speaker 7 to start outputting a warning sound (ACT 7).

Then, the controller 19 controls the stepping motor 27 so as to move the movable blade 62 from the accommodation position toward the cutting position at the second speed (ACT 8).

The controller 19 acquires the position of the movable blade 62 from the position sensor 30 and determines whether the movable blade 62 has reached the cutting position (ACT 9). When the controller 19 determines that the movable blade 62 has not reached the cutting position (ACT 9 "No"), the processes of ACT 8 and ACT 9 are repeated.

In addition, when the controller 19 determines that the movable blade 62 has reached the cutting position (ACT 9 "Yes"), it stops the movement of the movable blade 62 by stopping the stepping motor 27 (ACT 10). By such control, the movable blade 62 stops at the cutting position. Further, in this case, the controller 19 controls the speaker 7 to end the output of the warning sound (ACT 11). While the movable blade 62 is stopped at the cutting position, an operator cleans the movable blade 62 using, for example, a cotton swab or a dedicated brush.

Then, the controller 19 again determines whether the feed button 21 has been pressed (ACT 12). When it is determined that the feed button 21 has not been pressed (ACT 12 "No"), the controller 19 repeats the process of ACT 12 and waits. During this time, the movable blade 62 remains stopped at the cutting position.

When it is determined that the feed button 21 has been pressed (ACT 12 "Yes"), the controller 19 controls the stepping motor 27 to move the movable blade 62 from the cutting position toward the accommodation position at the first speed (ACT 13).

Then, the controller 19 acquires the position of the movable blade 62 from the position sensor 30 and determines whether the movable blade 62 has reached the accommodation position (ACT 14). When the controller 19 determines that the movable blade 62 has not reached the accommodation position (ACT 14 "No"), the processes of ACT 13 and ACT 14 are repeated.

When the controller 19 determines that the movable blade 62 has reached the accommodation position (ACT 14 "Yes"), it stops the movement of the movable blade 62 by stopping the stepping motor 27 (ACT 15). By such control, the movable blade 62 stops at the accommodation position. Here, the controller 19 ends the cleaning mode and returns to the normal operation mode. The process of this flowchart ends here.

In FIG. 4, it is determined whether the feed mode or the setting mode is started before the controller 19 determines the start of the cleaning mode. However, the flow of those processes is an example and the conditions for starting the feed mode or the setting mode are not limited to those.

In this way, when the feed button 21 receives the first operation instructing to start cleaning the movable blade 62, the label printer 10 of the embodiment controls the stepping motor 27 so as to move the movable blade 62 from the accommodation position to the cutting position at the second speed slower than the first speed which is the moving speed of the movable blade 62 during the cutting operation of the label paper P. Therefore, according to the label printer 10 of the embodiment, when an operator cleans the movable blade 62, the movable blade 62 is projected at a slow speed. Thus, it is possible to reduce the chance that an operator accidentally contacts the movable blade 62 and facilitate an operator to clean the movable blade 62.

When the movable blade 62 is at the accommodation position, the movable blade 62 is buried in the portion between the paper discharge port 18 of the lower case 4 and the platen roller 14, and therefore it is not easy to clean the movable blade 62. In addition, when the movable blade 62 is in the accommodation position, it may not be easy for an operator to visually recognize whether the adhesive material is attached to the movable blade 62. Therefore, it is not easy for an operator to know whether the cleaning is necessary and whether the cleaning is completed. Further, when the movable blade 62 is raised at the first speed as in the normal cutting operation, there is a high possibility that an operator will accidentally contact the movable blade 62.

Therefore, in the label printer 10 of the embodiment, by moving the movable blade 62 from the accommodation position to the cutting position, the movable blade 62 is projected from the portion between the paper discharge port 18 of the lower case 4 and the platen roller 14 so that an operator can easily clean the movable blade 62. Further, in the label printer 10 of the embodiment, the movable blade 62 is slowly moved at the second speed, thereby reducing the possibility that an operator accidentally contacts the movable blade 62.

Moreover, the label printer 10 of the embodiment further includes the speaker 7 which outputs a warning sound when the feed button 21 receives the first operation. Therefore, according to the label printer 10 of the embodiment, when the movable blade 62 moves from the accommodation position to the cutting position, a warning sound is emitted, so that an operator can be alerted to the protruding movable blade 62.

In addition, when the feed button 21 receives the second operation instructing the end of cleaning the movable blade, the label printer 10 of the embodiment controls the stepping motor 27 so as to return the movable blade 62 from the cutting position to the accommodation position. Therefore, according to the label printer 10 of the embodiment, an operator can return the movable blade 62 from the cutting position to the accommodation position at any timing.

When the feed button 21 receives the first operation when the upper case 3 is in the open state, the label printer 10 of the embodiment controls the stepping motor 27 to move the movable blade 62 from the accommodation position to the cutting position at the second speed. When the operator cleans the movable blade 62, the upper case 3 is opened. Therefore, when an operator performs the first operation when the upper case 3 is not open, there is a possibility of an erroneous operation. In the label printer 10 of the embodiment, as a condition for moving the movable blade 62 from the accommodation position to the cutting position at the second speed, not only the reception of the first operation but also the upper case 3 being in the open state are set. As a result, it is possible to reduce unnecessary movement of the movable blade 62.

First Modification Example

Although the movable blade 62 is moved by the rotation of the stepping motor 27 in the embodiment described above, the unit configured to move the movable blade 62 is not limited to this. For example, the label printer 10 may include a Direct Current (DC) motor instead of the stepping motor 27. When adopting the configuration, the controller 19 moves the movable blade 62 at the second speed slower than the first speed by intermittently energizing the DC motor in the cleaning mode at regular intervals. The DC motor is an example of the cutting mechanism and the drive mechanism in this modification example.

Second Modification Example

Further, in the embodiment described above, the label printer 10 is an example of the cutter device in the embodiment, but the cutter device is not limited to this. For example, the cutter device may not have a printing unit such as the thermal head 12. Specifically, the cutter device may be a device which cuts the label paper P that has already been printed, or a device that cuts a strip-shaped tape having an adhesive applied on one side.

Third Modification Example

Further, in the embodiment described above, the feed button 21 is an example of the operation unit, but the operation unit is not limited to this. For example, the operation unit may be a physical button other than the feed button 21. Further, the first operation and the second operation described in the above-described embodiment are examples, and other operations may instruct to start cleaning of the movable blade 62, or may instruct to end cleaning of the movable blade 62.

Further, the operation unit may be the touch panel display 5. As an example, the controller 19 may display on the touch panel display 5 an operation button capable of inputting an operation to start the cleaning mode.

Fourth Modification Example

In the embodiment described above, an example in which the fixed blade 61 is arranged further on an inner side than the movable blade 62 when viewed from the paper discharge port 18 is described, but the positional relationship between the fixed blade 61 and the movable blade 62 is not limited to this. For example, the movable blade 62 may be arranged further on the inner side than the fixed blade 61 when viewed from the paper discharge port 18.

Fifth Modification Example

Further, the position where the movable blade moves in the cleaning mode does not necessarily have to be the same as the cutting position, and the blade edge of the movable blade may be set to a position higher than the cutting position for easier cleaning.

Sixth Modification Example

The label printer 10 may include another platen instead of the platen roller 14. For example, the label printer 10 may include a flat platen. Further, the label paper P may be conveyed by a unit other than the platen.

As described above, according to the embodiment, cleaning of the cutter blade for cutting the linerless label can be facilitated.

The program executed by the label printer 10 of the embodiment is provided as an installable or executable file recorded in a computer-readable recording medium such as a CD-ROM, a flexible disk (FD), a CDR, and a DVD (Digital Versatile Disk).

Further, the program executed by the label printer 10 of the embodiment may be stored in a computer connected to a network such as the Internet and provided by being downloaded via the network. Further, the program executed by the label printer 10 of the embodiment may be configured to be provided or distributed via a network such as the Internet. Further, the program executed by the label printer 10 of the embodiment may be incorporated in a ROM or the like in advance and provided.

The program executed by the label printer 10 of the embodiment has a module configuration which can realize the above-described normal operation mode, feed mode, setting mode, and cleaning mode. The CPU (processor) reads the program from the storage medium and loads the function corresponding to each mode on the main storage device.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer device which prints on an adhesive member including an adhesive material on one surface, comprising:

a thermal head for printing on the adhesive member by generating heat;

a platen arranged to face the thermal head;

a fixed blade arranged at a position where a blade edge faces a conveyance path of the adhesive member conveyed between the thermal head and the platen;

a movable blade arranged at a first position where a blade edge of the movable blade faces the blade edge of the fixed blade via the conveyance path and moved at a first speed to a second position where the blade edge of the movable blade is brought into contact with the blade edge of the fixed blade;

an operation component which receives a first operation to start cleaning the movable blade; and a controller which moves the movable blade to a third position where the blade edge of the movable blade is exposed above the conveyance path at a second speed slower than the first speed when the operation component receives the first operation.

2. The printer device according to claim 1, further comprising:

an output component which outputs a warning sound when the operation component receives the first operation.

3. The printer device according to claim 1, wherein the operation component receives a second operation instructing to end cleaning of the movable blade, and the controller moves the movable blade so that the blade edge of the movable blade is located below the conveyance path when the operation component receives the second operation.

4. The printer device according to claim 1, wherein the thermal head, the platen, the fixed blade, the movable blade, and the controller are provided in a housing of the printer device, the housing includes an openable and closable a lid portion, and the controller moves the movable blade at the second speed to a fourth position where the blade edge of the movable blade is exposed above the conveyance path when the operation component receives the first operation when the lid portion is in an open state.

5. The printer device according to claim 4, wherein the third position and the fourth position are the same.

6. The printer device according to claim 4, wherein the third position and the fourth position are different.

7. The printer device according to claim 4, wherein the lid is pivotably attached to the housing.

8. The printer device according to claim 1, further comprising:

a stepping motor to move the movable blade.

9. The printer device according to claim 1, wherein the printer device is a thermal printer.

10. The printer device according to claim 1, wherein the printer device is a portable printer.

11. A cutter device which cuts an adhesive member including an adhesive material on one surface, comprising:

a fixed blade arranged at a position where a blade edge faces a conveyance path along which the adhesive member is conveyed;

a movable blade arranged at a first position where a blade edge of the movable blade faces the blade edge of the fixed blade and moved at a first speed to a second position where the blade edge of the movable blade is brought into contact with the blade edge of the fixed blade;

an operation component which receives a first operation to start cleaning the movable blade; and a controller which moves the movable blade to a third position where the blade edge of the movable blade is exposed above the conveyance path at a second speed slower than the first speed when the operation component receives the first operation.

12. The cutter device according to claim 11, further comprising:

an output component which outputs a warning sound when the operation component receives the first operation.

13. The cutter device according to claim 11, wherein the operation component receives a second operation instructing to end cleaning of the movable blade, and the controller moves the movable blade so that the blade edge of the movable blade is located below the conveyance path when the operation component receives the second operation.

14. The cutter device according to claim 11, wherein the fixed blade, the movable blade, and the controller are provided in a housing of the cutter device, the housing includes an openable and closable a lid portion, and the controller moves the movable blade at the second speed to a fourth position where the blade edge of the movable blade is exposed above the conveyance path when the operation component receives the first operation when the lid portion is in an open state.

15. The cutter device according to claim 14, wherein the third position and the fourth position are the same.

16. The cutter device according to claim 14, wherein the third position and the fourth position are different.

17. The cutter device according to claim 11, further comprising:

a stepping motor to move the movable blade.

18. A method for processing an adhesive member including an adhesive material on one surface, comprising:

positioning a fixed blade arranged at a position where a blade edge faces a conveyance path along which an adhesive member is conveyed;

moving at a first speed a movable blade arranged at a first position where a blade edge of the movable blade faces the blade edge of the fixed blade to a second position where the blade edge of the movable blade is brought into contact with the blade edge of the fixed blade;

receiving a first operation to start cleaning the movable blade; and moving the movable blade to a third position where the blade edge of the movable blade is exposed above the conveyance path at a second speed slower than the first speed when receiving the first operation.

19. The method according to claim 18, further comprising:

outputting a warning sound when receiving the first operation.

20. The method according to claim 18, further comprising:

receiving a second operation instructing to end cleaning of the movable blade; and moving the movable blade so that the blade edge of the movable blade is located below the conveyance path when receiving the second operation.

* * * * *